US009901140B1

(12) United States Patent
Fink

(10) Patent No.: US 9,901,140 B1
(45) Date of Patent: Feb. 27, 2018

(54) LACE SECURING APPARATUS

(71) Applicant: Fastech, Inc., Canton, MA (US)

(72) Inventor: Matthew Fink, Weston, MA (US)

(73) Assignee: Fastech, Inc., Canton, MA (US)

( * ) Notice: Subject to any disclaimer, the term of this patent is extended or adjusted under 35 U.S.C. 154(b) by 245 days.

(21) Appl. No.: 14/557,176

(22) Filed: Dec. 1, 2014

(51) Int. Cl.
*A43C 1/06* (2006.01)

(52) U.S. Cl.
CPC ..... *A43C 1/06* (2013.01)

(58) Field of Classification Search
CPC A43C 1/06; A43C 7/00; A43C 11/008; A43C 11/00; A43C 5/00; Y10T 24/37; Y10T 24/3724; Y10T 24/3732; Y10T 24/3734; Y10T 24/3737; Y10T 24/375; Y10T 24/3742; Y10T 24/3703; Y10T 24/3916; Y10T 24/3705; F16G 24/3705
See application file for complete search history.

(56) References Cited

U.S. PATENT DOCUMENTS 188,780 A 3/1877 Dawes
217,494 A 7/1879 Storer
602,841 A 4/1898 Earl
730,031 A 6/1903 Leopold
862,986 A 8/1907 Moore
1,019,024 A 3/1912 Clark
1,185,483 A 5/1916 Cole
1,412,486 A * 4/1922 Paine ..... A43C 1/00 24/713.3
1,445,683 A * 2/1923 Holliday ..... D06F 53/00 114/199
1,466,673 A 9/1923 Solomon et al.
1,541,654 A * 6/1925 O'Brien ..... H02G 11/003 24/129 A
2,356,908 A * 8/1944 Arrowsmith ..... D06F 53/04 24/129 R
4,290,173 A * 9/1981 Herlau ..... A43C 7/00 24/127
5,129,130 A * 7/1992 Lecouturier ..... A43C 7/00 24/712
5,349,726 A * 9/1994 Shapiro ..... A43C 7/00 24/712.5
5,566,474 A * 10/1996 Leick ..... A43C 1/00 24/713.4
6,502,329 B1 * 1/2003 Silagy ..... A43C 3/00 24/713.4
9,149,089 B2 * 10/2015 Cotterman ..... A43C 3/00
2002/0083621 A1 * 7/2002 Durocher ..... A43C 7/00 36/50.5
2003/0177661 A1 * 9/2003 Tsai ..... A43C 7/00 36/50.1

(Continued)

*Primary Examiner* — Robert Sandy
*Assistant Examiner* — Matthew J Sullivan
(74) *Attorney, Agent, or Firm* — Pryor Cashman LLP

(57) ABSTRACT

An apparatus for securing a lace onto footwear includes a base portion having a top surface, first and second ends, and first and second sides, a hook portion extending from the top surface of the base portion adjacent to the first end of the base portion and overlying the top surface of the base portion, and side walls extending upwardly from the top surface of the base portion adjacent to the first and second sides of the base portion, the top surface of the base portion, the hook portion and the side walls forming a channel into which the lace can be inserted and securely held.

5 Claims, 3 Drawing Sheets

(56) References Cited

U.S. PATENT DOCUMENTS

| | | | | |
|---|---|---|---|---|
| 2006/0054070 | A1* | 3/2006 | Lopes Praca | B60P 7/0823<br>114/218 |
| 2012/0246897 | A1* | 10/2012 | Lee | A43C 1/003<br>24/713.5 |
| 2014/0073495 | A1* | 3/2014 | Anderson | F16G 11/046<br>482/139 |
| 2014/0237774 | A1* | 8/2014 | Kline | F16G 11/046<br>24/129 R |

* cited by examiner

LACE SECURING APPARATUS

TECHNICAL FIELD

The present invention relates generally to devices attachable to laced footwear such as boots and shoes for securing laces onto the footwear.

BACKGROUND OF THE INVENTION

Prior devices attached to footwear for securing laces on the footwear have not adequately held the laces onto the footwear. In particular, such prior devices have not resulted in laces effectively held in place once inserted into the devices.

SUMMARY OF THE INVENTION

It is an object of the present invention to provide an apparatus that is attachable to footwear and that can be used to secure laces onto the footwear.

In general, in one aspect, the invention features an apparatus for securing a lace on footwear, including a base portion having a top surface, first and second ends, and first and second sides, a hook portion extending from the top surface of the base portion adjacent to the first end of the base portion and overlying the top surface of the base portion, and side walls extending upwardly from the top surface of the base portion adjacent to the first and second sides of the base portion, wherein the top surface of the base portion, the hook portion and the side walls form a channel into which the lace can be inserted and securely held.

Implementations of the invention may include one or more of the following features. The base portion may include an attachment point for securing the apparatus to the footwear. The apparatus may be formed from metal, which may include steel, stainless steel, copper, or brass. The apparatus may be formed from stamped metal.

BRIEF DESCRIPTION OF THE FIGURES

The above-mentioned and other aspects, features and advantages can be more readily understood from the following detailed description with reference to the accompanying drawings wherein.

DETAILED DESCRIPTION OF THE INVENTION

Figure 1:
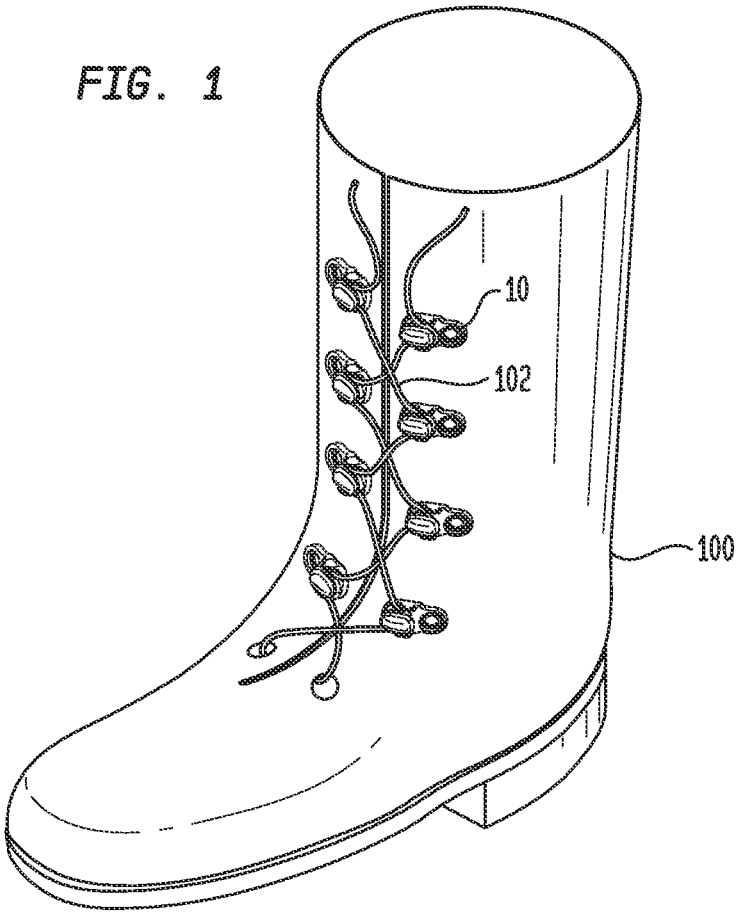
FIG. 1 shows a boot having a lace securing apparatus according to the present invention attached thereto.
Figure 2:
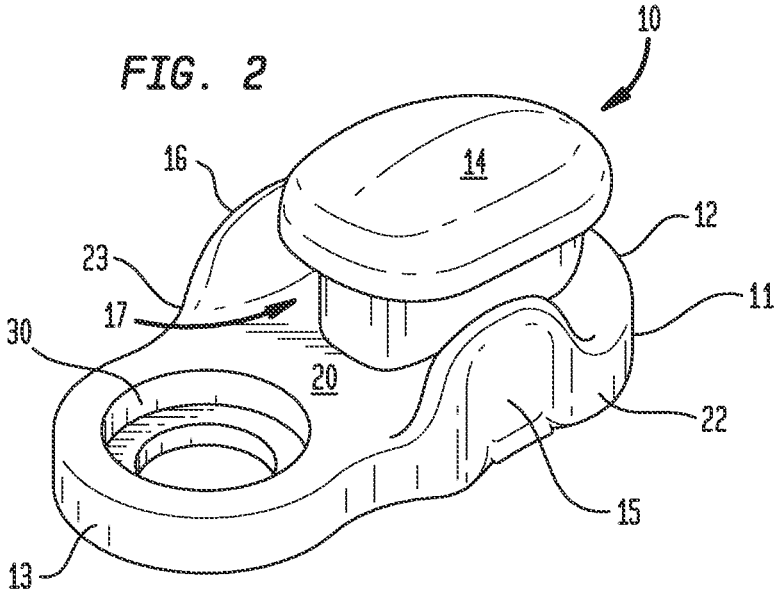
FIG. 2 is a side perspective view of a lace securing apparatus, according to an embodiment of the present disclosure.
Figure 3:
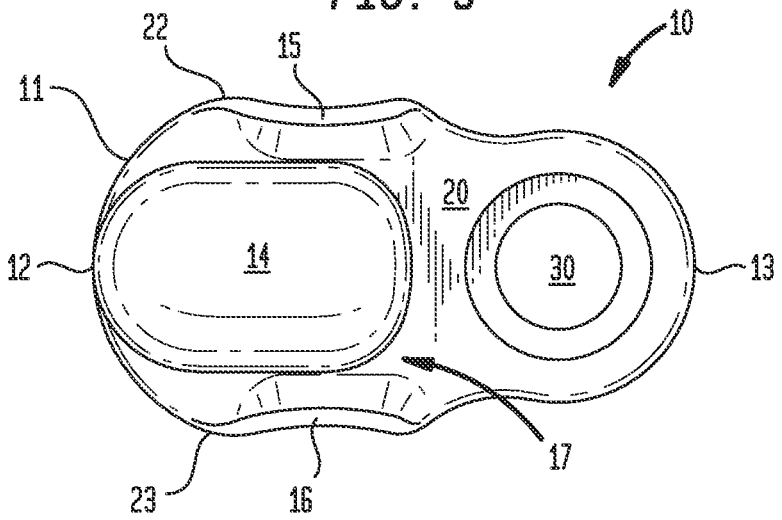
FIG. 3 is a top view of the lace securing apparatus of FIG. 1.
Figure 4:
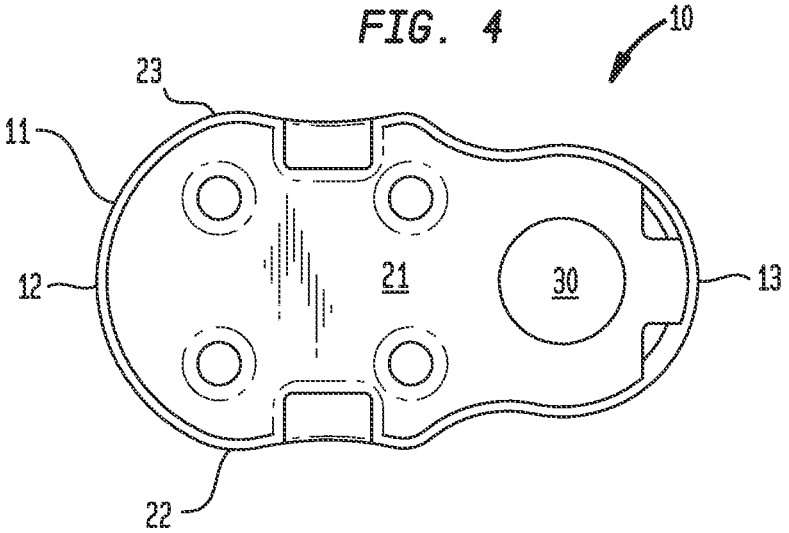
FIG. 4 is a bottom view of the lace securing apparatus of FIG. 1.
Figure 5:
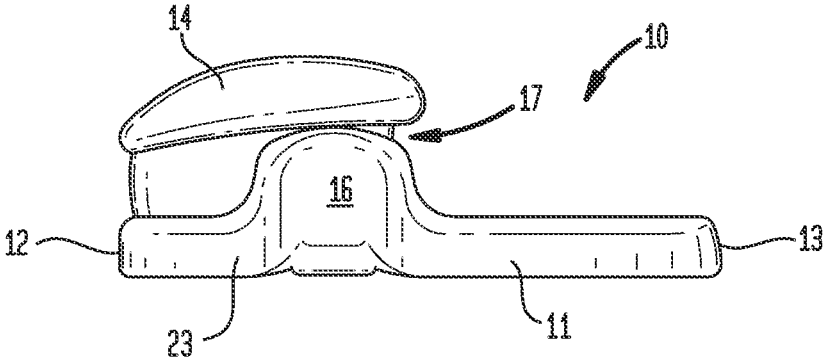
FIG. 5 is a right side view of the lace securing apparatus of FIG. 1.
Figure 6:
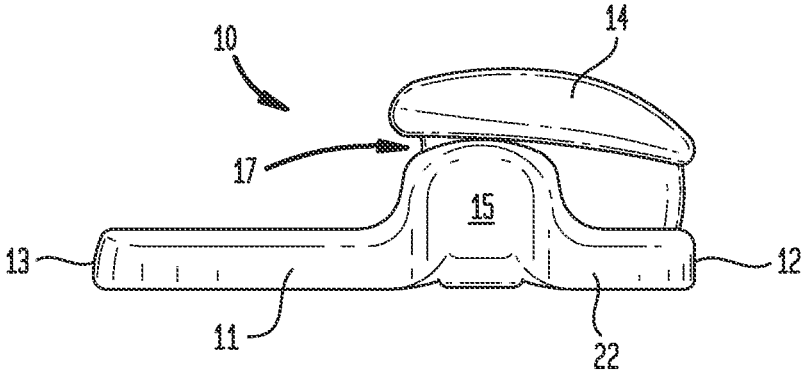
FIG. 6 is a left side view the lace securing apparatus of FIG. 1.
Figure 7:
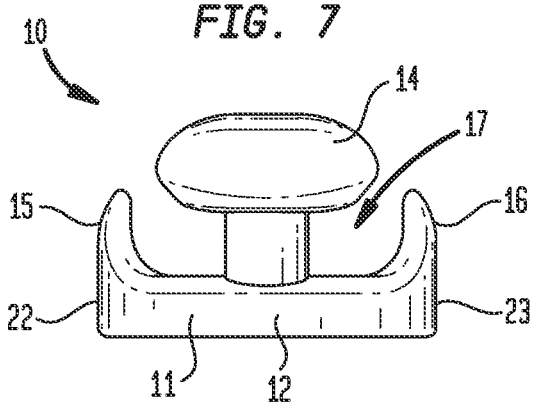
FIG. 7 is a front view of the lace securing apparatus of FIG. 1.
Figure 8:
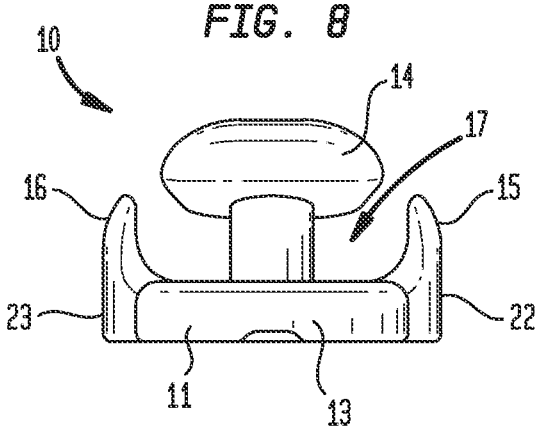
FIG. 8 is a back view of the lace securing apparatus of FIG. 1.

The present invention provides an apparatus or device 10 for securing laces on any type of footwear 100 such as a boot, as shown in FIG. 1.

As shown in FIGS. 2 through 7, apparatus 10 includes a base portion 11 having top and bottom surfaces 20 and 21, first and second ends 12 and 13, and first and second sides 22 and 23. A hook portion 14 extends from the top surface of the base portion adjacent to the first end of the base portion and overlies the top surface of the base portion. Side walls 15 and 16 extend upwardly from the top surface of the base portion adjacent to the first and second sides of the base portion. Side walls 15 and 16 are not contiguous with hook portion 14, and there is a gap along the top surface of the base portion between each of side walls 15 and 16 and hook portion 14. By this arrangement, a channel 17 is formed between the top surface of the base portion, the hook portion, and the side walls into which a lace can be inserted and secured from the direction of the second end of the base portion opposite the first end. The gaps between side walls 15 and 16 and hook portion 14 assist in securely holding a lace within channel 17.

In one embodiment, the apparatus is formed of metal, preferably stamped rolled metal. The metal may be steel, stainless steel, copper, or brass. Brass or steel may be less expensive to use and form into stampable parts than other metal alloys.

Apparatus 10 can be attached to footwear through any conventional means. In one embodiment, the apparatus 10 includes an eyelet 30 in base portion 11 that serves as an attachment point for securing attaching apparatus 10 to the surface of the footwear, such as through the use of a rivet. The rivet may be configured so that the head of the rivet fits securely within eyelet 30 and fixedly attaches the bottom surface of the base portion against the surface of the footwear. Other means of securing apparatus 10 to the footwear includes threading through one or more eyelets in one or more surfaces or portions of the base portion.

FIGS. 2-8 illustrate different views of apparatus 10.

The embodiments and examples above are illustrative, and many variations can be introduced to them without departing from the spirit of the disclosure or from the scope of the appended claims. For example, elements and/or features of different illustrative and exemplary embodiments herein may be combined with each other and/or substituted with each other within the scope of this disclosure. The objects of the invention, along with various features of novelty that characterize the invention, are pointed out with particularity in the claims annexed hereto and forming a part of this disclosure. For an understanding of the invention, its operating advances and the specific objects attained by its uses, reference should be had to the accompanying drawings and descriptive matter in which there is illustrated a preferred embodiment of the invention.

What is claimed is:

1. An apparatus for securing a lace on footwear, comprising:

a base portion having a top surface, first and second ends, and first and second sides;

a hook portion extending from the top surface of the base portion adjacent to the first end of the base portion and overlying the top surface of the base portion; and side walls extending upwardly from the top surface of the base portion adjacent to the first and second sides of the base portion;

wherein the side walls are not contiguous with the hook portion, forming a gap along the top surface of the base portion between the side walls and the hook portion;

wherein the top surface of the base portion, the hook portion and the side walls form a channel into which the lace can be inserted and securely held; and wherein the base portion includes an eyelet configured to serve as an attachment point for securing the apparatus to the footwear.

2. The apparatus of claim 1 wherein the apparatus is formed from metal.

3. The apparatus of claim 2 wherein the metal includes steel or brass.

4. The apparatus of claim 1 wherein the apparatus is formed from stamped metal.

5. The apparatus of claim 2 wherein the metal includes steel, stainless steel, copper, or brass.

* * * * *